US006885267B2

(12) United States Patent
Kuriyama et al.

(10) Patent No.: US 6,885,267 B2
(45) Date of Patent: Apr. 26, 2005

(54) MAGNETIC-FIELD-GENERATING APPARATUS AND MAGNETIC FIELD ORIENTATION APPARATUS USING IT

(75) Inventors: Yoshihiko Kuriyama, Saitama-ken (JP); Keiko Kikuchi, Saitama-ken (JP)

(73) Assignee: Hitachi Metals Ltd., Tokyo (JP)

( * ) Notice: Subject to any disclaimer, the term of this patent is extended or adjusted under 35 U.S.C. 154(b) by 0 days.

(21) Appl. No.: 10/801,576

(22) Filed: Mar. 17, 2004

(65) Prior Publication Data

US 2004/0263303 A1 Dec. 30, 2004

(30) Foreign Application Priority Data

Mar. 17, 2003 (JP) ..... 2003-71551

(51) Int. Cl.[7] ..... H01F 7/02
(52) U.S. Cl. ..... 335/306
(58) Field of Search ..... 335/296–306; 324/318–320

(56) References Cited

U.S. PATENT DOCUMENTS 5,103,200 A * 4/1992 Leupold ..... 335/217
5,216,400 A * 6/1993 Leupold ..... 335/306
5,216,401 A * 6/1993 Leupold ..... 335/306
5,523,731 A * 6/1996 Leupold ..... 335/306
5,532,666 A * 7/1996 Leupold ..... 335/306
5,634,263 A * 6/1997 Leupold ..... 29/607
5,990,774 A * 11/1999 Leupold ..... 335/306
6,303,908 B1 10/2001 Yamaga et al.
6,396,378 B1 * 5/2002 Leupold ..... 335/306

FOREIGN PATENT DOCUMENTS

| | | |
|---|---|---|
| JP | 2704352 | 9/1997 |
| JP | 11-25424 | 1/1999 |
| JP | 3115243 | 9/2000 |

* cited by examiner

*Primary Examiner*—Ramon M. Barrera
(74) *Attorney, Agent, or Firm*—Sughrue Mion, PLLC

(57) ABSTRACT

An magnetic-field-generating apparatus comprising permanent magnet segments arranged to form a ring-shaped magnetic circuit having a center hole; adjacent permanent magnet segments having such different magnetization directions that their magnetization directions successively change along a circumferential direction of the magnetic circuit; a basic magnetization phase angle θ between the magnetization directions of the adjacent permanent magnet segments being 720/N (°); and a magnetization direction of at least one permanent magnet segment in an essential unit obtained by circumferentially dividing the ring to ¼ being deviated from the basic magnetization phase angle θ by such a deviating angle that a uniform magnetic flux flows in one direction along a diameter of the center hole.

10 Claims, 9 Drawing Sheets

MAGNETIC-FIELD-GENERATING APPARATUS AND MAGNETIC FIELD ORIENTATION APPARATUS USING IT

FIELD OF THE INVENTION

The present invention relates to an apparatus comprising pluralities of permanent magnets arranged in a ring shape with a center hole such that their magnetization directions are successively changed to generate a uniform, parallel magnetic field in the hole, and a magnetic field orientation apparatus comprising such a magnetic-field-generating apparatus, for instance, a furnace for heat-treating wafers with magnetic films in a magnetic field to orient the magnetic films in one direction, a die for magnetically orienting sintered permanent magnets and resin-bonded magnets so that they have magnetic anisotropy in the process of compression molding or extrusion molding, etc.

BACKGROUND OF THE INVENTION

A conventionally known apparatus for obtaining magnetic field strength without using exciting current is a Halbach-type magnetic circuit. This magnetic circuit is disclosed in "Journal of Applied Physics," Vol. 86, No. 11, Dec. 1, 1999, "Journal of Applied Physics," Vol. 64, No. 10, Nov. 15, 1988, and Japanese Patents 2,704,352 and 3,115,243. This Halbach-type magnetic circuit comprises pluralities of permanent magnet segments having different magnetization directions arranged to form a synthetic magnetic field oriented in one direction. In the cylindrical arrangement of pluralities of permanent magnet segments SB1 to SB12 shown in FIG. 17, for instance, a permanent magnet segment SB1 is adjacent to the next permanent magnet segment SB2 having a magnetization direction at a certain angle θ to the magnetization direction of the segment SB1, and the subsequent permanent magnet segments are arranged similarly so that their magnetization directions are changed successively, thereby generating a strong, uniform, parallel magnetic field B in the center hole of a magnetic circuit. The conventionally known Halbach-type magnetic circuits have a cylindrical or rectangular magnetic circuit.

Apparatuses comprising conductive coils or superconductive coils are also known as magnetic field sources for apparatuses for generating as strong a magnetic field as about 1 T (Tesla).

A magnetic-field-generating apparatus needing such a strong, uniform magnetic field will be explained, taking a heat treatment step of wafers with magnetic films in a magnetic field for example.

Magnetoresistive (MR) heads, giant magnetoresistive (GMR) heads, magnetic random access memory (MRAM), etc. generally have structures in which pluralities of ferromagnetic films are laminated on a substrate. For instance, the GMR head has a structure comprising a non-magnetic, insulating film between ferromagnetic films. The MRAM has a structure comprising an antiferromagnetic film, a pinned magnetic film, a non-magnetic conductive film and a free magnetic layer in this order from the side of a substrate. The pinned film and the antiferromagnetic film should have magnetization oriented in one direction as a whole.

This orienting step is carried out just after the formation of films on a substrate by sputtering or reactive deposition, and thus it needs a heat treatment in a uniform, parallel magnetic field. An oriented magnetic field of 0.5 T (tesla) or more is usually necessary to be applied, and an oriented magnetic field of more than 1.0 T is necessary depending on the materials of the pinned film or the antiferromagnetic film.

Described in U.S. Pat. No. 6,303,908 is a furnace for heat-treating wafers while applying an oriented magnetic field. A magnetic field-generating means in, this furnace comprises an electromagnetic coil, to which as large electric current as 500–800 A should be supplied to generate a magnetic field of 1.0 T or more. Accordingly, such a magnetic field-generating means uses large electric power, needing safety means and other facilities, and thus a large cost for generating a magnetic field and a large amount of cooling water to remove heat generated by large electric current. Also, because this magnetic field-generating means comprises an iron core and an electromagnetic coil, it weighs 3 to 5 tons to generate a large magnetic field, resulting in restricted installation sites on floors with small strength. Further, because there is an extremely large leaked magnetic flux in the above structure, there should be a large space in addition to a facility space for the sake of safely. In addition, the apparatus should be enclosed by a magnetic body such as iron, Permalloy, etc. to prevent adverse influence on nearby electronic equipments and humans.

A superconductive coil can generate a magnetic field without using large electric power. Though the superconductive coil consumes less exciting current than an electromagnet, liquid nitrogen or helium should always be consumed to keep superconductivity, resulting in a high operation cost. Also, in a system using a superconductive coil, the variation of a magnetic field turns superconductivity to normal conductivity locally, resulting in heat generation in the coil, and if this state were left to stand, the superconductivity of the entire apparatus would be destroyed. Though the superconductive coil can generate as strong a magnetic field as several teslas to several tens of teslas, the range of a strong leaked magnetic field expands in proportion to its magnetic field strength like the electromagnet. Accordingly, it seriously suffers from the problem of a leaked magnetic field like the electromagnet.

JP 11-25424 A proposes a magnetic field-applying apparatus comprising permanent magnets. However, because this apparatus mostly serves to adjust a magnetic field distribution, it generates only a small magnetic field strength, unusable for an orientation apparatus using a strong magnetic field.

Magnetic circuits using electromagnets or superconductive magnets appear to suffer from problems in terms of the generation of a uniform magnetic field. Thus, a Halbach-type magnetic circuit using only permanent magnets is considered promising to solve the above-mentioned problems.

When a wafer having a magnetoresistive film is heat-treated, as large a magnetic field as 1.0 T or more is generally required to stably improve magnetoresistance. Further, the magnetic field need be applied uniformly and in parallel to the magnetization direction of the magnetic film. However, the conventional magnetic-field-generating apparatus using electromagnets, superconductive magnets or permanent magnets cannot generate a strong, uniform, parallel magnetic field.

The inventors have thus considered the use of a Halbach-type magnetic circuit as such a magnetic-field-generating apparatus. However, there is no precedent of using the Halbach-type magnetic circuit for a magnetic-field-generating apparatus for such a heat-treating furnace, needing to investigate the uniformity and parallelness of a magnetic field in a magnetic circuit hole.

It has thus been found that a magnetic field generated by the Halbach-type magnetic circuit is not necessarily uniform. As shown by MS in FIG. 17, for instance, a magnetic flux has disturbed linearity at a tip end in a progressing direction, resulting in non-parallelness, which is called "magnetization bending." Magnetic field parallelness, which may be called deviating angle or skew angle, is used as an index of the degree of magnetization bending. This indicates an x component vertical to a main magnetic-field-generating direction, namely a deviation (degree) of a magnetic field-applying direction in a cross section (x-y plane) from the main magnetic-field-generating direction (y direction) in a uniform magnetic field region. It is required that this deviation is as small as possible in a region, in which wafers are subjected to an orientation treatment. Specifically, a magnetic field parallelness of ±2° or more adversely affects magnetic film characteristics.

Particularly, this magnetic-field-generating apparatus has a cylindrical center hole, in which magnetic field parallelness drastically decreases as separating from a longitudinal center. The above magnetic field parallelness of within +2° is satisfied only in a region corresponding to a half-length or less of this cylindrical hole. Accordingly, the magnetic-field-generating apparatus should have a cylindrical hole as long as two times or more a treatment region to surely treat sufficient numbers of articles, resulting in larger size and higher production cost.

OBJECTS OF THE INVENTION

Accordingly, an object of the present invention is to provide an apparatus for generating a uniform, parallel magnetic field as strong as 1.0 T or more with suppressed magnetization bending in a cylindrical hole over a substantially entire length thereof.

Another object of the present invention is to provide a magnetic field orientation apparatus comprising the above magnetic-field-generating apparatus, suitable for a furnace for heat treatment in a magnetic field, etc., which can be operated safely at a low cost with high accuracy.

SUMMARY OF THE INVENTION

The magnetic-field-generating apparatus of the present invention comprises permanent magnet segments in the number of N, wherein N is an even number of 4 or more, arranged to form a ring-shaped magnetic circuit having a center hole; adjacent permanent magnet segments having such different magnetization directions that their magnetization directions successively change along a circumferential direction of the magnetic circuit; a basic magnetization phase angle θ between the magnetization directions of the adjacent permanent magnet segments being 720/N (°); and a magnetization direction of at least one permanent magnet segment in an essential unit obtained by circumferentially dividing the ring to ¼ being deviated from the basic magnetization phase angle θ by such a deviating angle that a uniform magnetic flux flows in one direction along a diameter of the center hole.

A magnetic field orientation apparatus of the present invention can further comprise a heat treatment apparatus disposed in the hole of the magnetic-field-generating apparatus, the heat treatment apparatus comprising a cooling means, a heating means, and a means for holding articles to be heat-treated in this order from outside.

Because the ring-shaped magnetic circuit have four symmetric quarters as shown in FIG. 1, the explanation of the magnetic circuit can be made referring to an upper right quarter ring (quarter magnetic circuit in the first quadrant), which may be called an essential unit. The magnetization direction of this essential unit changes in a clockwise direction, and at least one permanent magnet segment therein has a magnetization direction deviated from the basic magnetization phase angle θ in a clockwise direction.

In one embodiment of the present invention, the permanent magnet segments are arranged with a predetermined gap between the adjacent ones. The gap may be filled with a non-magnetic body.

Investigation has been conducted, presuming that a magnetization bending phenomenon affects a relative position of magnetic flux to each permanent magnet segment in the magnetic-field-generating apparatus. As a result, it has been found that the magnetization bending phenomenon can be effectively eliminated by deviating the magnetization directions of permanent magnet segments constituting the magnetic circuit from the basic magnetization phase angle θ.

In the essential unit in the first quadrant, a permanent magnet segment having a magnetization direction to be deviated from the basic phase angle θ clockwise is most desirably a segment arranged at about 45°. The degree of deviation from the basic magnetization phase angle θ is desirably +15° or less, assuming that the clockwise direction is a positive direction. However, the deviation from the basic magnetization phase angle θ preferably does not go to a minus direction. The deviation is preferably +1° to +20°, more preferably +5° to +10°, particularly about +5°.

The magnetic-field-generating apparatus of the present invention is constituted by a substantially ring-shaped magnetic circuit. Referring to FIG. 1, in order that magnetic flux flows in one direction along a diametric direction of the hole, magnetization directions successively change clockwise in the first and third quadrants, and counterclockwise in the second and fourth quadrants. The segments most effective for suppressing magnetization bending are about 45° in the first quadrant, about 135° in the second quadrant, about 225° in the third quadrant, and about 315° in the fourth quadrant, from a positive part of the y-axis (axis of ordinates).

In the magnetic-field-generating apparatus of the present invention, the number N of permanent magnet segments is preferably 8 to 20, more preferably 10 to 16, particularly 12 from the aspects of the strength, uniformity and parallelness of a magnetic field, the easiness of assembling a magnetic circuit, and a production cost.

In the magnetic-field-generating apparatus, the magnetic field parallelness (deviating angle or skew angle) at least at about 45° is within ±1° within 50 to 70% from the center of the hole in a substantially entire axial region of the magnetic circuit.

Also, the present invention provides a magnetic field orientation apparatus comprising the above magnetic-field-generating apparatus around a magnetic orientation die for producing permanent magnets.

BRIEF DESCRIPTION OF THE DRAWINGS

FIG. 11(*b*) is a schematic view showing an example of the magnetic-field-generating apparatus of the present invention, in which there are no gaps between permanent magnet segments;

DETAILED DESCRIPTION OF THE PREFERRED EMBODIMENTS

Embodiments of the present invention will be explained in detail below.

Figure 1:
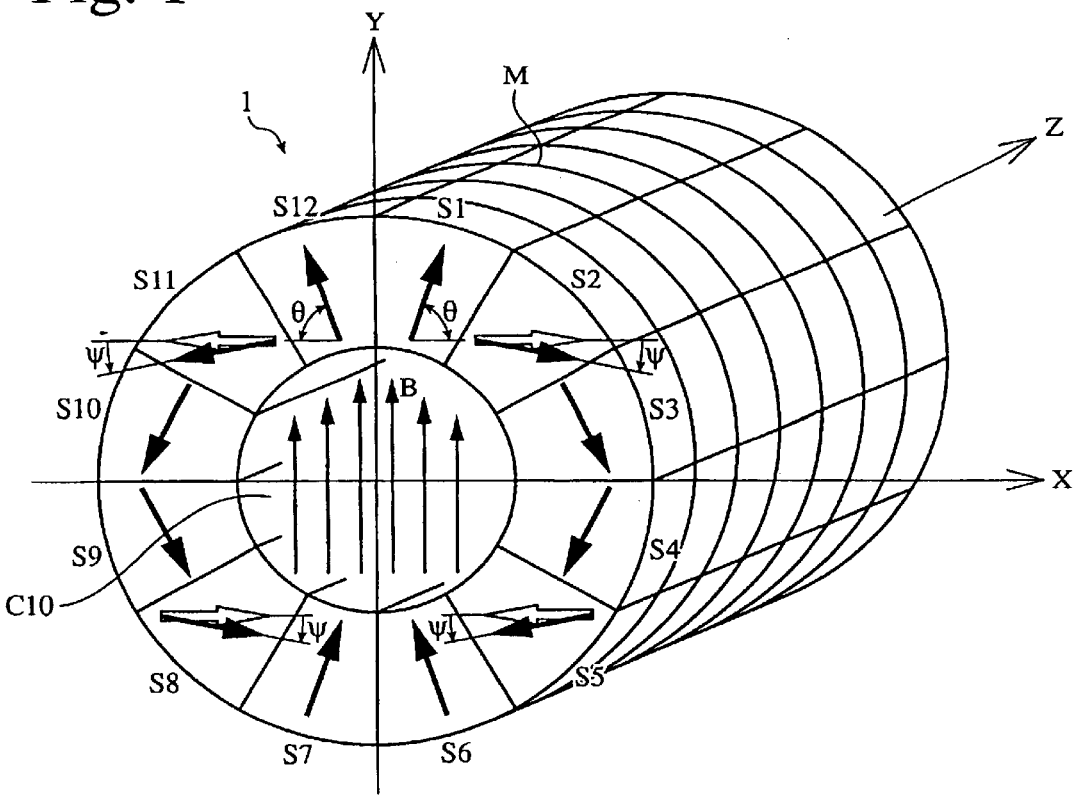
FIG. 1 is a schematic perspective view showing the structure of one example of the magnetic-field-generating apparatus of the present invention.

FIG. 1 is a schematic perspective view showing the magnetic-field-generating apparatus of the present invention, in which permanent magnet segments with different magnetization directions are assembled in a ring shape to constitute a cylindrical Halbach-type magnetic circuit. In this example, the ring is divided to 12 segments, and each permanent magnet segment S1 to S12 is constituted by pluralities of permanent magnets M assembled such that a synthetic magnetic field of these permanent magnets is directed as shown by the arrows B.

In this magnetic-field-generating apparatus 1, a magnetization phase angle θ between the magnetization directions of adjacent permanent magnet segments is determined by θ=720/N(°). Accordingly, when the number N of permanent magnet segments is 8, 10, 12, 16, 20, the magnetization phase angle θ is 90°, 72°, 60°, 45° and 36°, respectively. This is called "basic magnetization phase angle." A successively changing magnetization direction can be obtained by assembling the permanent magnet segments at this angle, thereby forming a uniform magnetic field B in a center hole C10 in parallel to its diametric direction as shown in FIG. 1. However, a magnetization-bending phenomenon actually occurs to some extent, because the drastic change of a magnetization direction between pluralities of segments affects a magnetic field in a center hole. A means for buffering this effect is to increase the number of segments to reduce magnetic variations in the hole, thereby securing a uniform magnetic field in a wider region. In other words, increase in the number of segments is preferable for the formation of wide region of a uniform magnetic field. However, about 10 segments are necessary, and up to 20 segments are practical, taking into consideration characteristics and production cost.

Figure 2:
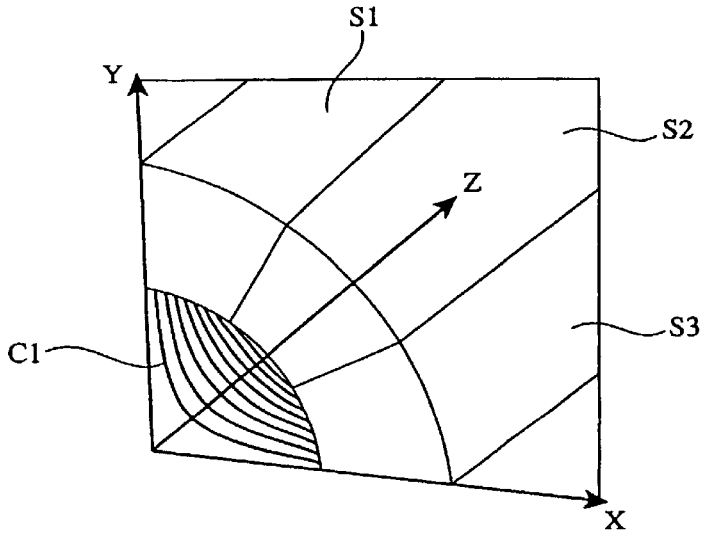
FIG. 2 is a view showing a magnetic field distribution in a center hole of the magnetic-field-generating apparatus of the present invention.

To obtain a uniform magnetic field in a wider region, it is necessary to reduce magnetization bending in an axial (length) direction of a magnetic circuit. This is "to increase magnetic field parallelness," or "to reduce a deviating angle or a skew angle." To minimize this value leads to the suppression of the magnetization bending. The present invention is based on the discovery that the magnetization bending can be reduced by changing the magnetization directions of the permanent magnet segments from the above basic phase angle. Specifically, using a model of a 12-divided, ring-shaped magnetic circuit, investigation has been conducted on a quarter ring as an essential unit. The calculation results of a magnetic field distribution in the hole are shown in FIG. 2. This figure shows the magnetic field parallelness by contour lines C1. This analysis has indicated that because the magnetic field parallelness is minimum (a deviating angle or a skew angle is maximum) at about 45° on an outer surface of the essential unit, the magnetization direction of the magnet at about 45° affects the uniformity of a magnetic field.

Figure 3:
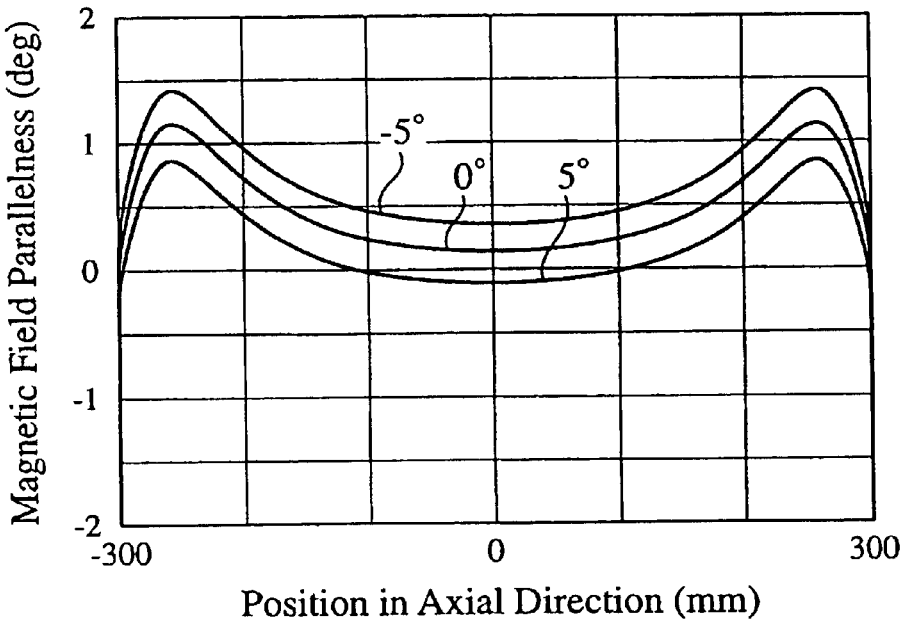
FIG. 3 is a graph showing the change of magnetic field parallelness in the magnetic-field-generating apparatus of the present invention when part of permanent magnet segments change their phase angles.

The magnetic field parallelness will then be explained. When a magnetization direction changes from a basic angle by an angle Ψ of ±5° in permanent magnet segments S1, S6, S7, S12 at 15°, 165°, 195° and 345°, respectively, from a positive part of the y-axis in the ring-shaped magnetic circuit in FIG. 1, the magnetic field parallelness changes in the hole in an axial (length) direction as shown in FIG. 3. In FIG. 3, the axis of ordinates indicates the magnetic field parallelness, and the axis of abscissas indicates the length of the magnetic circuit. Accordingly, FIG. 3 shows the change of a magnetic field parallelness in a range of ±300 mm vertically from the center of the magnetic circuit in an axial (length) direction.

Figure 4:
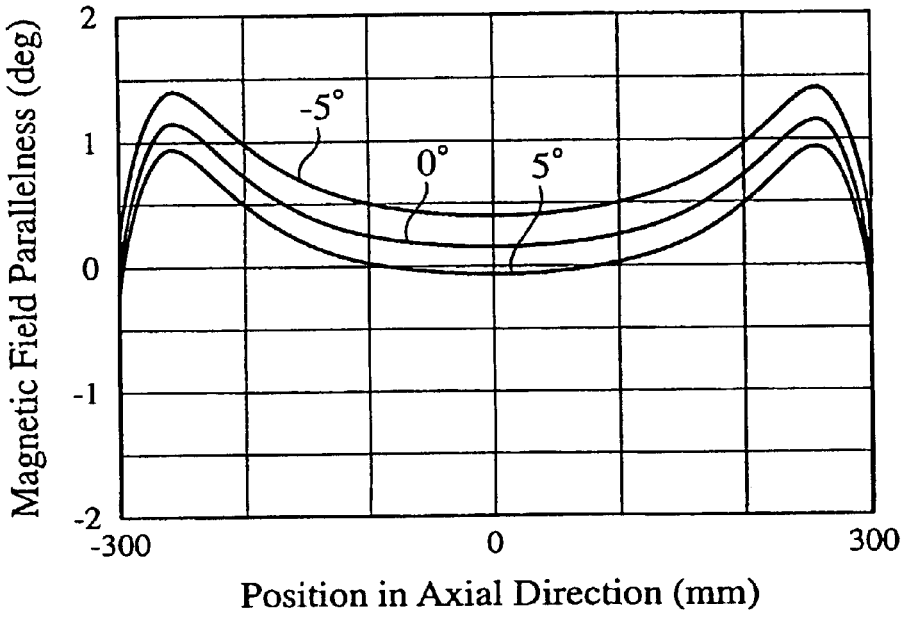
FIG. 4 is a graph showing the change of magnetic field parallelness in the magnetic-field-generating apparatus of the present invention when part of permanent magnet segments change their phase angles.

FIG. 4 shows the change of a magnetic field parallelness in the hole of a magnetic circuit in an axial direction, when the magnetization direction changes from the basic angle by an angle Ψ of ±5° in permanent magnet segments S3, S4, S9 and S10 at 75°, 105°, 255° and 285°, respectively, from a positive part of the y-axis.

Figure 5:
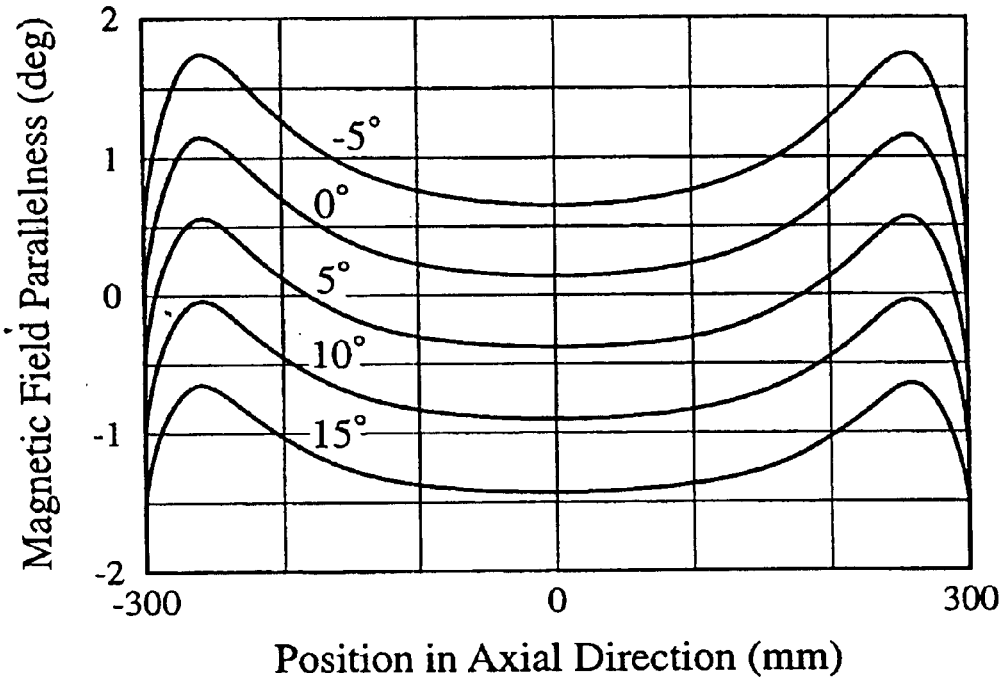
FIG. 5 is a graph showing the relation between magnetic field parallelness and an axial position at various deviating angles Ψ from the magnetization phase angle θ in the magnetic-field-generating apparatus of the present invention.

Similarly, FIG. 5 shows the change of a magnetic field parallelness in the hole of a magnetic circuit in an axial direction, when the magnetization direction changes from the basic angle by an angle Ψ of −5° to +15° in permanent magnet segments S2, S5, S8 and S11 at 45°, 135°, 225° and 315°, respectively, from a positive part of the y-axis.

As shown in these figures, the magnetic field parallelness can be kept within 1° at Ψ of about 5° in the entire axial direction of the magnetic circuit. However, as shown in FIG. 5, when a permanent magnet segment positioned at about 45° in a magnetic circuit of each essential unit is inclined, the magnetic field parallelness is within ±0.5° at Ψ=5°, exhibiting higher effect of increasing the magnetic field parallelness. It is thus confirmed that the magnetic field parallelness can be increased, and thus the magnetization bending can be suppressed, by changing the basic phase angles of the permanent magnet segments, and that the magnetic field parallelness can be more effectively increased by changing the phase angles of segments arranged at about 45° in each magnetic circuit.

Next, with respect to an essential unit on upper right of a quarter ring, an in-plane magnetic flux density distribution (corresponding to FIG. 2) has been investigated at deviating angles Ψ of −5° to +15° from the basic magnetization phase angle θ, assuming that a clockwise direction is positive. Specifically, the magnetic field parallelness (deg) was determined in an entire axial length (±300 mm) of a magnetic circuit at a position of 45°. The results are shown in FIG. 5. In FIG. 5, the axis of ordinates indicates a magnetic field parallelness, and the axis of abscissas indicates the length of a magnetic circuit. Thus, FIG. 5 shows the change of a magnetic field parallelness over ±300 mm from the center of magnetic circuit. It is clear from FIG. 5 that over 300 mm from the center of a magnetic circuit, there is a large region having a magnetic field parallelness of 1° or more, and even a region having a magnetic field parallelness of 1.5° or more, at a deviating angle Ψ of −5°. At a deviating angle Ψ of 0°, there are some regions (near ±300 mm at both ends), in which the magnetic field parallelness exceeds 1°. On the other hand, at deviating angles Ψ of 5° to 10°, the magnetic field parallelness is within ±1° in an entire axial region. However, it has been found that at a deviating angle Ψ of 15°, the magnetic field parallelness exceeds −1° and is close to −1.5°, resulting in a large deviation from the magnetic field parallelness. Though the optimum range of the deviating angle Ψ may be slightly different depending on the dimension of a magnetic circuit, etc., it is generally $0° < \Psi \leqq 15°$. However, taking into consideration the working precision of about ±5°, the deviating angle Ψ is preferably in a range of about $0° < \Psi \leqq 20°$, in which the magnetic field parallelness can be as good as within ±1°. Particularly at a deviating angle of about 5°, the deviation from the magnetic field parallelness is smallest in an entire hole region.

Figure 6:
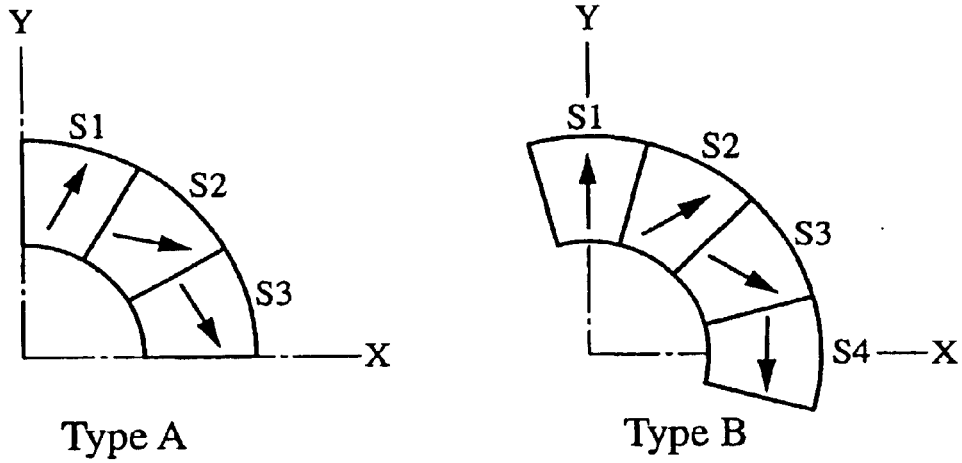
FIG. 6 is a view showing examples of the arrangement of permanent magnet segments in the magnetic-field-generating apparatus of the present invention.

A permanent magnet segment having a phase angle to be deviated is a segment S2 positioned at about 45° in the essential unit shown in FIG. 2. Additional segments having phase angles to be deviated are a segment S5 at about 135°, a segment S8 at about 225° and a segment S11 at about 315° in the entire magnetic circuit shown in FIG. 1, the segments S2, S8 being changed in the clockwise direction, and the segments S5, S11 being changed in the counterclockwise direction, within the deviating angles Ψ of 15° or less. There may be, for instance, types A and B of segment arrangements different in an x-y plane as shown in FIG. 6. In the case of the type B, it is desirable that phase angles are changed in two segments S2, S3 arranged at about 45°.

Figure 7:
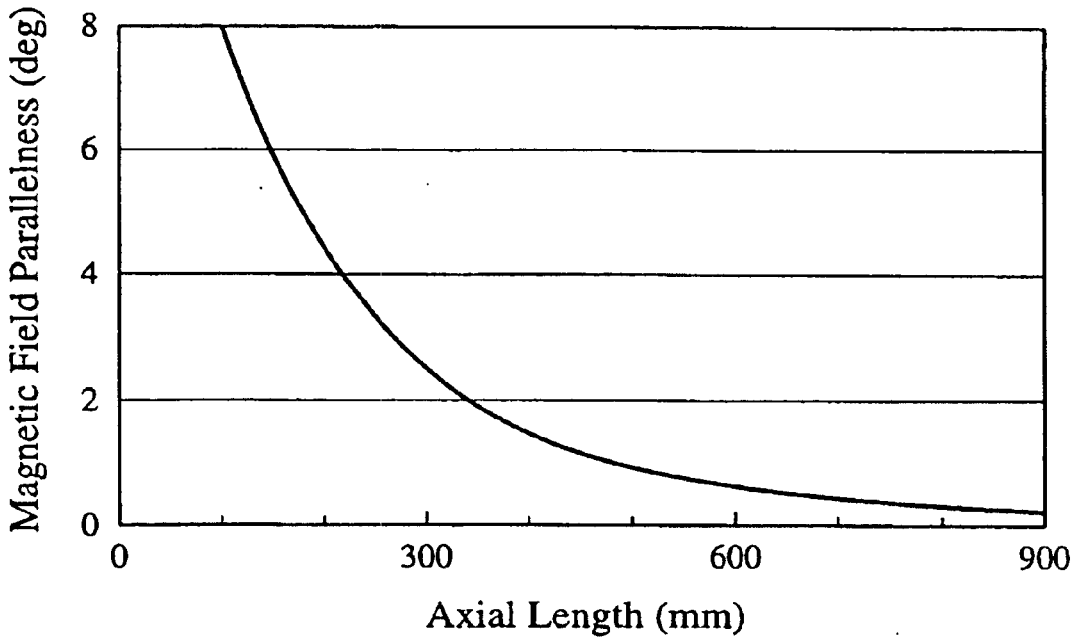
FIG. 7 is a graph showing the dependence of magnetic field parallelness on axial length in the magnetic-field-generating apparatus of the present invention.

It is known that the magnetic field parallelness also depends on the axial length of a magnetic circuit. As shown in FIG. 7, the larger the axial length of a magnetic circuit, the better the parallelness. Though the axial length of about 300 mm or more is desirable, the longer magnetic circuit results in a drastically increased weight. Accordingly, it is desirable to reduce the length of the magnetic circuit while keeping the parallelness. The change of the magnetization phase angle θ not only corrects the magnetization bending but also increases the precision of the magnetic field parallelness, making it possible to reduce the length of the magnetic circuit while keeping a parallelness equal to the conventional one. Only part of the magnetic circuit can be used for an orientation treatment, because the magnetic field parallelness is conventionally poor at both ends. However, the present invention makes it possible to use the entire magnetic circuit. Therefore, various magnetic film-carrying wafers, etc. can be treated at different orientation magnetic field strengths in the same apparatus, making it unnecessary to use pluralities of apparatuses corresponding to different orientation magnetic field strengths, thereby drastically reducing a facility cost.

Permanent magnets used in the permanent magnet segments are preferably those having a residual magnetic flux density of 1.1 T or more and coercivity of 1114 kA/m (14 kOe) or more, for instance, rare earth magnets such as Nd—Fe—B magnets, Sm—Co magnets, Sm—Fe—N magnets, etc. Examples of magnets having a residual magnetic flux density of less than 1.1 T include ferrite magnets such as Ba-ferrite magnets, Sr-ferrite magnets, ferrite magnets containing La and Co, and rare earth magnets such as Sm—Co magnets, Sm—Fe—N magnets. Nd—Fe—B magnets having a high residual magnetic flux density are particularly preferable from the aspects of productivity and production cost. The permanent magnets are not limited to sintered magnets but may be bonded magnets. Though it has been difficult to use Nd—Fe—B magnets for conventional heat-treating furnaces because of low heat resistance, it has become possible to use them by providing the cooling means between the heat treatment apparatus and the magnetic-field-generating apparatus.

Investigation has been conducted on the desirable number of permanent magnet segments for stabilizing magnetic field strength, magnetic field uniformity and magnetic field parallelness.

(a) Uniformity of Magnetic Field

Figure 8:
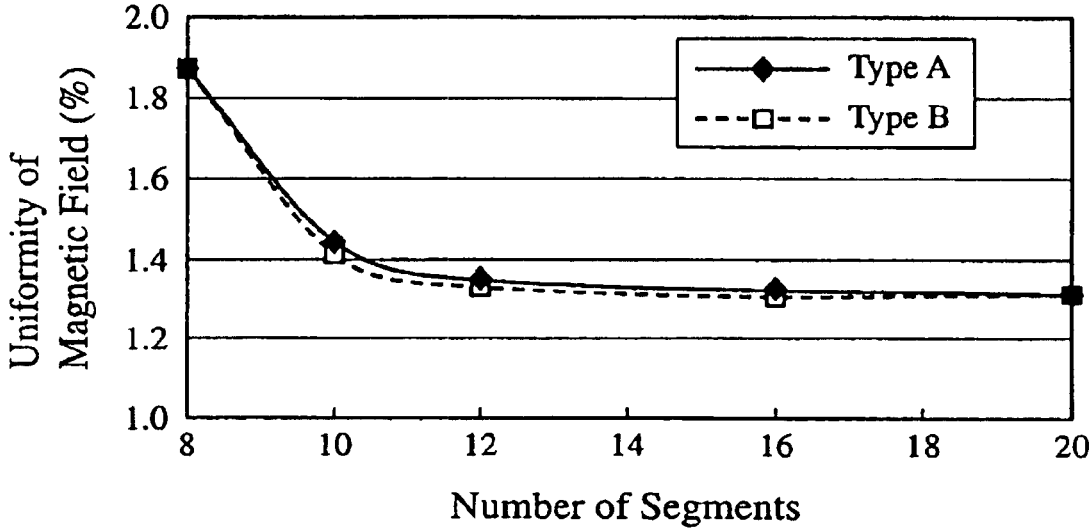
FIG. 8 is a graph showing the relation between the uniformity of a magnetic field and the number of segments in the magnetic-field-generating apparatus of the present invention.

The uniformity of a magnetic field is represented by $(T_{max}-T_{min})/T_{max}$, wherein $T_{max}$ is the maximum magnetic flux density, and $T_{min}$ is the minimum magnetic flux density. The uniformity of a magnetic field in a region of 120 mm in diameter from the center of the magnetic circuit hole and 150 mm from an axial center is shown in FIG. 8. In FIG. 8, the axis of ordinates indicates the uniformity of a magnetic field, and the axis of abscissas indicates the number of segments. In FIG. 8, the types A and B respectively are as shown in FIG. 6. It is clear from FIG. 8 that the uniformity of a magnetic field is not affected by how the magnetic circuit is divided, namely the difference in the types A and B, and that more uniformity is not expected by increasing the number of division to 12 or more.

(b) Magnetic Field Strength at Center

Figure 9:
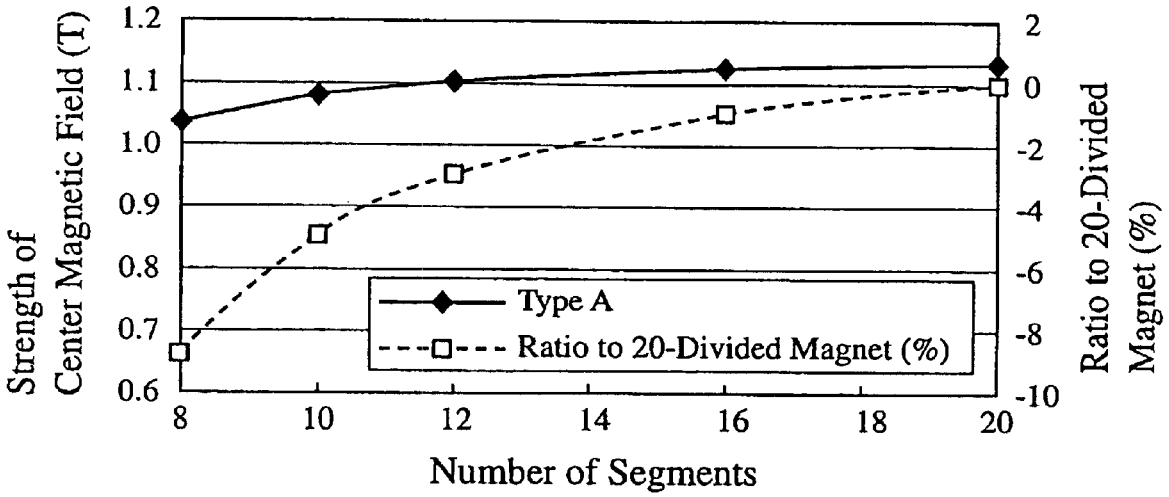
FIG. 9 is a graph showing the relation between the strength of a center magnetic field and the number of segments in the magnetic-field-generating apparatus of the present invention.

The magnetic field strength at a center is determined for a magnetic flux density at an axial center of the center hole in a main magnetic-field-generating direction. The main magnetic-field-generating direction is the direction of a magnetic field generated in the center hole of a magnetic circuit as shown in FIG. 1. FIG. 9 shows the relation between a center magnetic field strength (T) and the number of segments. A ratio to the center magnetic field strength when the magnet is divided to 20 is shown by the dotted line in FIG. 9. It is clear from FIG. 9 that though the center magnetic field strength gradually increases as the number of segments increases, it substantially levels off at 12 or more of division. As shown by the dotted line, the ratio of a center magnetic field relative to when the magnet is divided to 20 is within about 3% when the number of division is 12.

(c) Magnetic Field Parallelness

Figure 10:
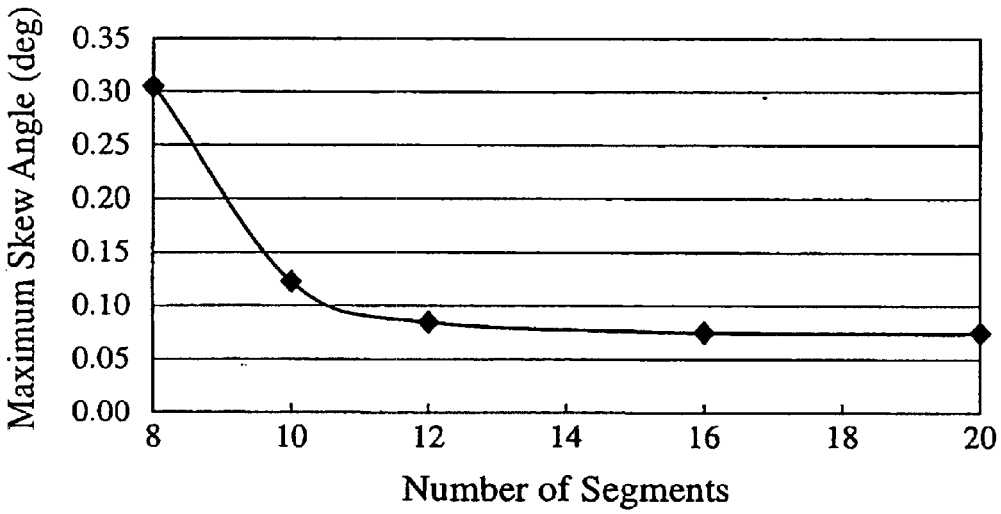
FIG. 10 is a graph showing the relation between a maximum skew angle and the number of segments in the magnetic-field-generating apparatus of the present invention.

The magnetic field parallelness (deviating angle or skew angle) is defined as the maximum deviating angle of a magnetic field-applying direction in an entire evaluation region corresponding to an installation site of a work to be treated. FIG. 10 shows the relation between the maximum skew angle and the number of segments. It is clear from FIG. 10 that the maximum magnetic field parallelness decreases as the number of segments increases, and that it becomes substantially constant without further decrease when the number of division is 12 or more.

Though a region with a small skew angle (good magnetic field parallelness) generally increases in the cylindrical hole in proportion to the longitudinal length of the magnetic-field-generating apparatus, the weight of permanent magnets used also increases, resulting in increase in the weight of the magnetic-field-generating apparatus and a higher production cost.

In addition to the above evaluation, evaluation from the viewpoints of production and economy is needed. The larger the number of permanent magnet segments, the more complicated assembling and the more types of permanent magnets needed, resulting in higher cost.

In view of the above, in the magnetic-field-generating apparatus of the present invention, the number N of permanent magnet segments is properly 8 to 20, desirably 10 to 16, most desirably 12.

Figure 11A:
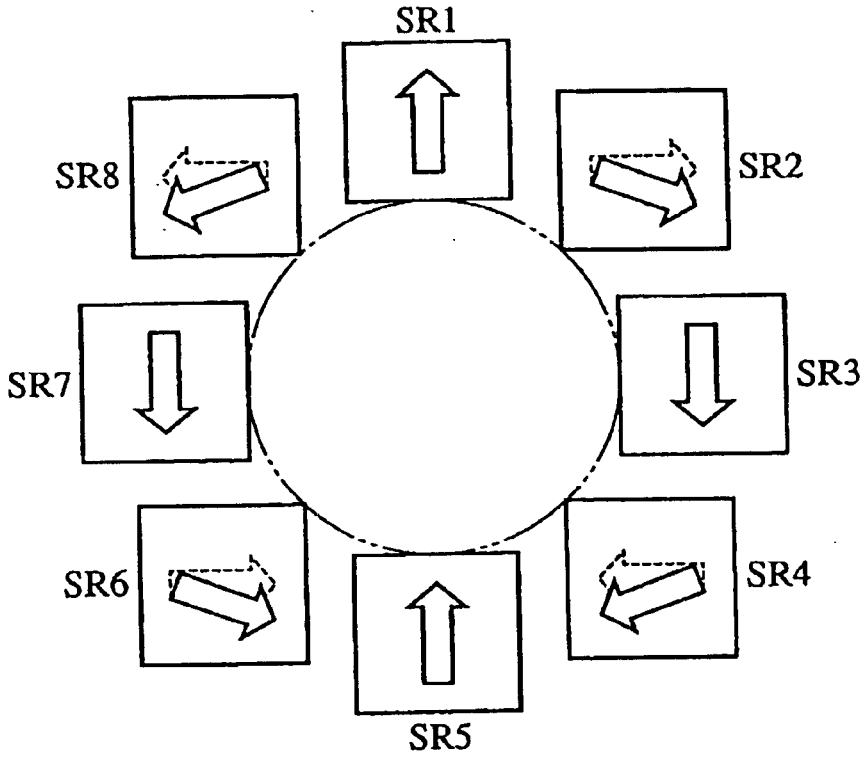
FIG. 11(*a*) is a schematic view showing an example of the magnetic-field-generating apparatus of the present invention, in which there are gaps between permanent magnet segments.
Figure 11B:
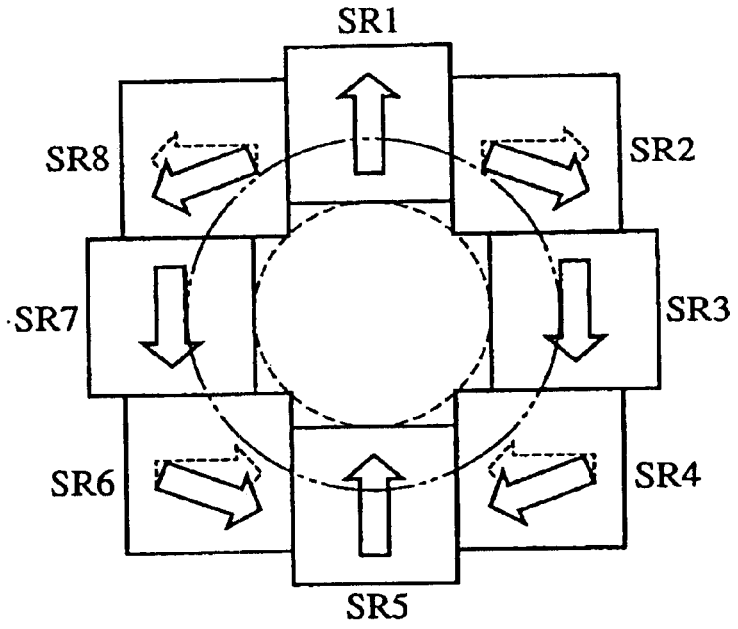

FIG. 11 shows an example, in which there are gaps between permanent magnet segments. This example is mainly based on the consideration of the easiness of production and assembling of permanent magnet segments and cost, etc. Particularly when the permanent magnet segments are in a rectangular shape, it is easy and inexpensive to produce the entire magnetic-field-generating apparatus. In FIG. 11 (*a*), rectangular permanent magnet segments of the same shape are arranged with predetermined gaps, and an angle between the magnetization directions of the adjacent permanent magnet segments is deviated from the basic phase angle θ as described above. The magnetization directions of permanent magnet segments SR2, SR4, SR6 and SR8 are changed at an angle Ψ of 5°. Though the number of segments is 8 here, more segments may of course be arranged. Because the permanent magnet segments are not in a trapezoidal or fan shape, gaps are needed between the permanent magnet segments as shown in this figure, to generate a uniform, parallel magnetic field in the hole by their circular arrangement. Though gaps may be eliminated, the center hole has a small inner diameter as shown in FIG. 11(*b*) in that case, resulting in a proportionally small region of a uniform, parallel magnetic field. However, such example is an effective means to treat, for instance, small-diameter wafers.

The magnetic-field-generating apparatus of the present invention will be explained referring to Examples below.

EXAMPLE 1

Figure 12:
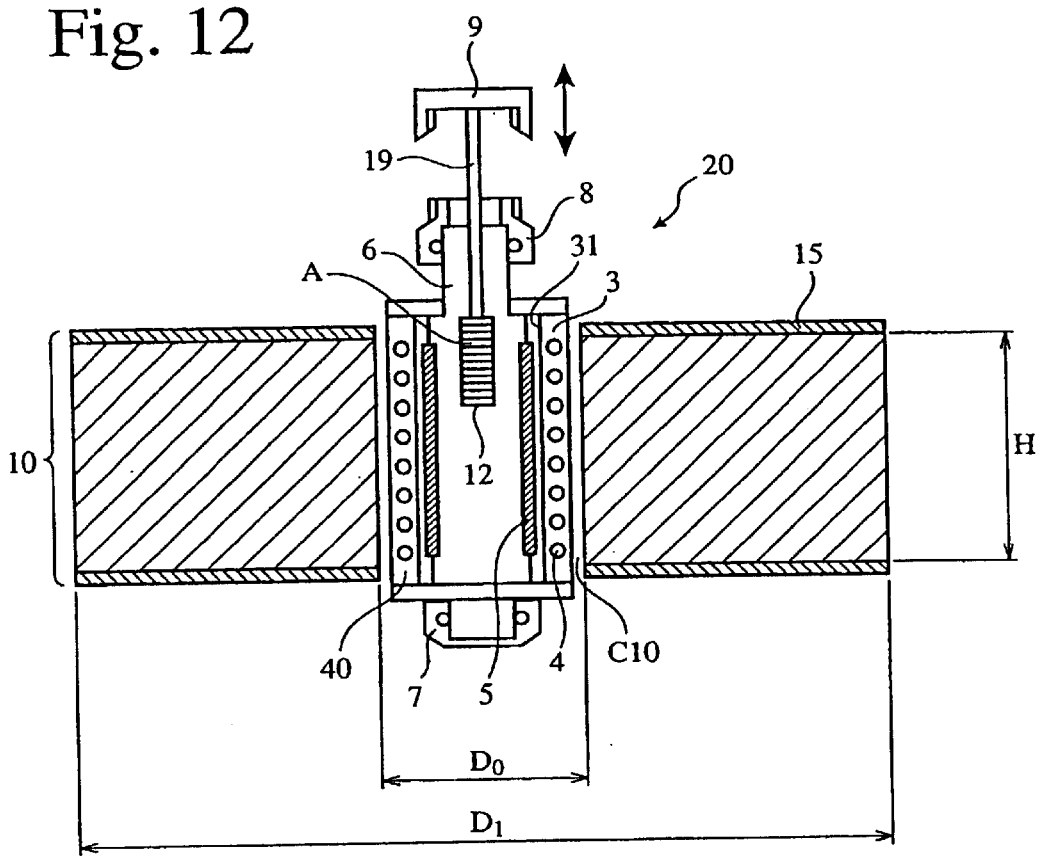
FIG. 12 is a cross-sectional view showing one example of a furnace for heat treatment in a magnetic field using the magnetic-field-generating apparatus of the present invention.

The magnetic-field-generating apparatus of the present invention was used for a furnace for heat treatment in a magnetic field (simply "heat-treating-in-magnetic-field furnace") shown in FIG. 12. The heat treatment in a magnetic field may be called "annealing."

The magnetic-field-generating apparatus 10 comprises 12 equal-sized magnetic segments as shown in FIG. 1. Every permanent magnet of each segment was formed by a sintered Nd—Fe—B magnet having a residual magnetic flux density of 1.45 T and coercivity of 1192 kA/m. The ring-shaped, magnetic-field-generating apparatus 10 is formed by circumferentially arranging 12 fan-shaped permanent magnet segments S1 to S12 having three types of magnetization anisotropy. Because the fan-shaped permanent magnet segments S1 to S112 have the same shape, their center angle is 30°, and their basic phase angle θ is 60°. Because of three types of segments, many types of permanent magnets having different magnetic field orientations need not be used. Each permanent magnet segment may be trapezoidal or rectangular instead of fan-shaped. Because it is difficult to constitute a large permanent magnet segment by one permanent magnet, such segment is constituted by pluralities of small permanent magnets. Though not shown, the outer periphery of a magnetic circuit constituted by pluralities of the permanent magnet segments is held by pluralities of axially divided outer frame member (outer ring). Each permanent magnet segment is mechanically connected to the outer ring by support members such as screws, such that attraction and repulsion generated by the permanent magnet segments are received by the outer ring. These segments are integrally adhered in a ring shape to constitute the magnetic-field-generating apparatus 10.

As described above, pluralities of permanent magnet segments assembled in a ring shape in the magnetic-field-generating apparatus 10 have successively changing magnetization directions, so that a synthetic magnetic flux flows in the center hole in a diametric direction. With respect to the permanent magnet segments S2, S5, S8, S11 (see FIG. 1) arranged at positions corresponding to 45°, 135°, 225° and 315°, respectively, from the center of the ring-shaped magnetic circuit, which had a magnetization phase angle θ of 60° as shown by white arrows, the magnetization phase angle θ of the segments S2, S8 was changed by +5° clockwise as shown by black arrows, and the magnetization phase angle θ of the segments S5, S11 was changed by +5° counter-clockwise as shown by black arrows. In this Example, the deviating angle Ψ was 5°, and the skew angle was within 1°. The magnetic circuit had an inner diameter $D_0$ of 220 mm, an outer diameter $D_1$ of 850 mm, and an axial length (length) H of 600 mm. To treat 5-inch wafers, a region of a uniform magnetic field should have a diameter of 125 mm in the hole. This is 56% to the inner diameter $D_0$ of the magnetic circuit.

A heat treatment apparatus 20 comprises a furnace wall 3 comprising a stainless steel plate 31 with a mirror-finished inner surface, a cooling means 4 disposed inside the furnace wall 3, and an electric heater 5 made of carbon, etc. and disposed inside the cooling means 4 for heating articles A. The cooling means 4 comprises a cooling jacket 40 comprising a water-cooling pipe, to keep the furnace wall 3 at 30° C. or lower to protect the magnetic-field-generating apparatus 10 from heat. The cooling means 4 may comprise a heat sink and/or an insulator in addition to the cooling jacket 40. In this case, the heat sink, etc. may be disposed between the cooling jacket 40 and the magnetic-field-generating apparatus 10. Because the articles A are mainly wafers of 5 to 8 inches, the electric heater 5 may have an inner diameter of about 170 to 250 mm. Because articles of 12 inches (300 mm) are expected to be heat-treated in the future, the electric heater 5 may have a larger inner diameter. This heat treatment apparatus is in vacuum inside the furnace wall 3. This makes it possible to heat wafers A nearby, resulting in improved control and thus improved uniformity of wafer temperatures, thereby achieving a higher productivity.

The furnace wall 3 has one end sealed by a seal member 7 and the other end sealed by a sealing male screw 8 and a sealing female screw 9. An upper part of the furnace wall 3 is sealed by a vacuum tube 6 and a sealing male screw 8. The sealing female screw 9 has a shaft 19 provided with a holder 12 for holding the articles A inside the furnace wall 3 substantially at a center.

The heat-treating holder 12 has a structure comprising about 25 trays for supporting, for instance, wafers having thin magnetic layers at an interval of about 3 to 10 mm in an axial direction. The tray interval is preferably proportional to the diameter of each article A. The magnetic-field-generating apparatus 10 of the present invention can meet the requirement of the magnetic field parallelness in a wide axial range, advantageous for the heat treatment of large-diameter wafers with higher production efficiency. The heat-treating holder 12 is rotatable in a horizontal plane inside the furnace wall 3. The heat-treating holder 12 is preferably rotated such that the articles A are always kept in the same direction as that of the synthesized magnetic field.

The temperature was measured by thermocouples equipped at the upper, middle and lower ends of the heat-treating holder 12 to carry out the PID control of the temperature of the electric heater 5. The seal portion 7 has a gas inlet. An evacuation outlet connected to a vacuum pump (not shown) is provided in an upper portion of the vacuum tube 6, to keep the inside of the furnace wall 3 in a vacuum state. When the articles A to be heat-treated are, for instance, wafers having thin magnetic layers, the heat treatment is carried out preferably in vacuum of about $1\times10^{-5}$–$1\times10^{-6}$ Pa. The gas inlet is connected to a nitrogen gas tank to provide an inert atmosphere inside the furnace wall 3, if necessary.

The heat treatment is carried out as follows. Pluralities of wafers having thin magnetic layers constituted by laminating pluralities of ferromagnetic films and antiferromagnetic films via non-magnetic insulating layers are disposed on the trays of the heat-treating holder 12, and inserted into the heat-treating furnace 20. All stacked wafers were positioned such that their center was substantially identical with the axial center of the magnetic-field-generating apparatus 10.

After the sealing female screw 9 was screwed to the sealing male screw 8 to make the furnace wall 3 gas-tight, the inside of the furnace wall 3 was evacuated to a vacuum degree of $1\times10^{-5}$–$1\times10^{-6}$ Pa by a vacuum pump.

Figure 13:
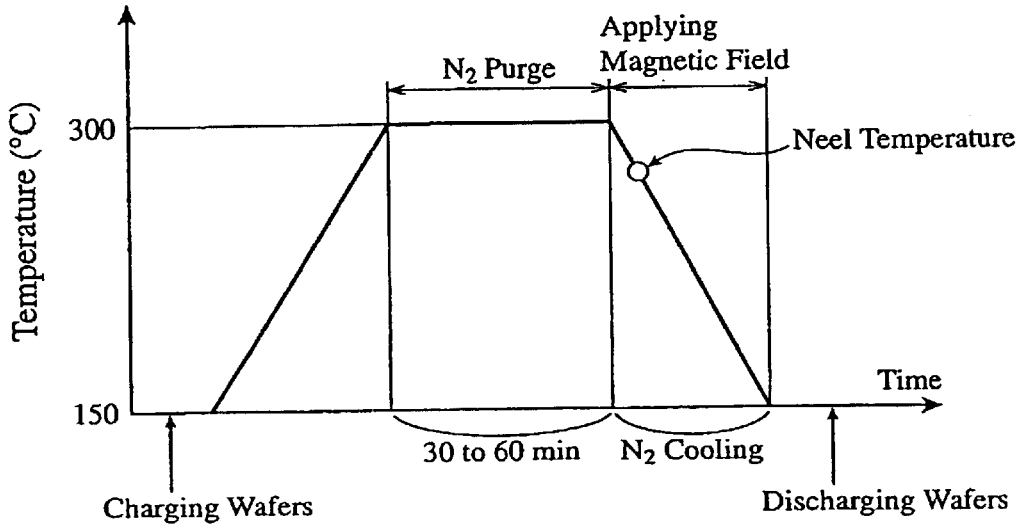
FIG. 13 is a diagram showing a heat treatment process using the furnace for heat treatment in a magnetic field.

As shown by the heat treatment steps in FIG. 13, the furnace was heated to 300° C. at a speed of 30° C./min by the electric heater 5. Cooling water is supplied to the cooling tube 4 to keep the outer surface of the magnetic-field-generating apparatus 10 at about 30° C., substantially equal to an ambient temperature. The air inside the furnace was purged with a nitrogen gas while keeping the wafers at 300° C. lest that an oxide layer was formed on a wafer surface, and the wafers were annealed at a Curie temperature or higher of the ferromagnetic film and at the Neel temperature or higher of the antiferromagnetic film, for instance, at a temperature of 300° C.±3% for 30–60 minutes. Thereafter, while evacuating the furnace together with nitrogen gas purge, the inside of the furnace wall 3 was cooled at a speed of 10° C./min. At a time when the wafer temperature became 150° C. or lower, the wafers were taken out of the furnace. In order that magnetic films on the wafers exhibit sufficient characteristics, the above-described heat treatment should be conducted for a long period of time. Accordingly, if the number of wafers treated by one heat treatment step increased, the apparatus would exhibit improved treatment capacity, resulting in a decreased production cost and thus increased productivity.

If a uniform magnetic field were applied in one direction during cooling the wafers, namely while the wafers pass through the Curie temperature and the Neel temperature, the magnetic films would be magnetically oriented in that direction, though magnetic films would not be influenced by a magnetic field at lower temperatures. Accordingly, even if there is a magnetic field in the hole from the beginning, there would be no substantial problems on the magnetic films on wafers.

If the heat-treated wafer is 5 inches (125 mm) in diameter, the heater 5 should be as thick as 5 mm, and the furnace wall 3 should have an inner diameter of 170 mm to secure a gap of 17.5 mm between the outer peripheries of the wafers and the furnace wall 3. With a 10-mm-thick furnace wall 3, and with a 5-mm total clearance between the members, the inner diameter $D_0$ of the magnetic circuit should be 200 mm or more. With a permanent magnet having a residual magnetic flux density Br of 1.45 T, the magnetic-field-generating apparatus should have an outer diameter $D_1$ of 850 mm or more to have a magnetic field strength exceeding 1.4 T in the center hole. Also, the magnetic-field-generating apparatus should have an axial length H of 600 mm or more. To have sufficient mechanical strength, the outer ring should be as thick as 30 mm or more, and the magnetic-field-generating apparatus should have a final outer diameter $D_1$ of about 910 mm.

Adjusting the above-described magnetization phase angle θ further increases the magnetic field parallelness. Though the axial length for achieving a magnetic field parallelness of within 1° is conventionally as small as about 450 mm, the magnetic field parallelness is within 1° in a substantially entire axial region of 600 mm in this Example, meaning that the entire region is usable and thus greatly advantageous from the aspect of production efficiency.

Even in a magnetic-field-generating apparatus with insufficient orientation magnetic field strength at ends, the entire region of the hole can be used, for instance, with a portion of 450 mm including the axial center usable for thin films that can be oriented in a strong magnetic field, and with upper and lower portions of 150 mm in total usable for thin films that can be oriented in a weak magnetic field. Such use makes it possible to treat many types of wafers by one apparatus, resulting in decreased production cost, and providing the apparatus for heat treatment in a magnetic field with many functions, improving production efficiency, and reducing the number of apparatuses installed, thereby lowering a total production cost.

EXAMPLE 2

The magnetic-field-generating apparatus of the present invention was used in an apparatus for extrusion-molding permanent magnets in this Example.

Figure 14:
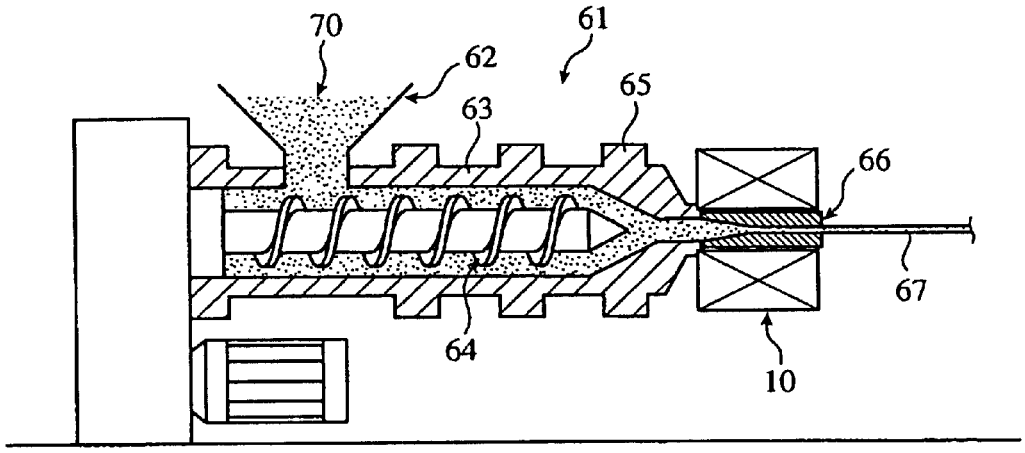
FIG. 14 is a cross-sectional view showing one example of an extrusion-molding apparatus using the magnetic-field-generating apparatus of the present invention.

FIG. 14 shows one example of the apparatus of the present invention for extrusion molding in a magnetic field. Like Example 1, the magnetic-field-generating apparatus 10 comprised a 12-divided magnetic circuit, each segment being constituted by pluralities of sintered Nd—Fe—B permanent magnets having a residual magnetic flux density of 1.45T and coercivity of 1192 kA/m. The magnetic circuit had an inner diameter $D_0$ of 220 mm, an outer diameter $D_1$ of 850 mm, and an axial length (length) H of 600 mm.

A starting material mixture mainly comprising magnet powder such as Nd—Fe—B rare earth magnet powder and a thermoplastic resin (for instance, polyamide resin) is thermally blended, and extrusion-molded in a magnetic field. This green body is magnetized along an anisotropy direction to obtain an anisotropic extrusion-molded body. In the extrusion-molding apparatus shown in FIG. 14, a double-screw extruder 61 comprises a plurally divided barrel 63 having a hopper 62 at one end, two screws 64 (only one screw is shown in FIG. 14) disposed inside the barrel 63, and an adaptor 65 mounted to a tip end of the barrel 63. A forming die assembly 66 is connected to an outlet of the adaptor 65, and the magnetic-field-generating apparatus 10 is arranged around the forming die assembly 66.

Figure 15:
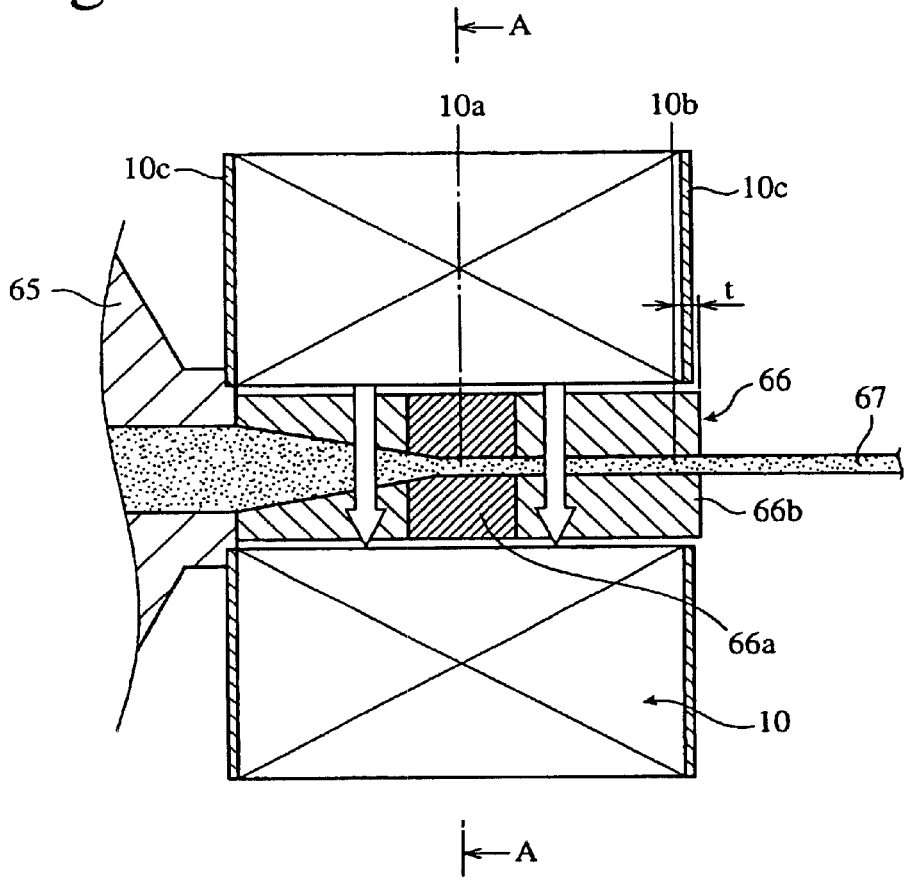
FIG. 15 is an enlarged cross-sectional view showing a forming die assembly of the extrusion-molding apparatus.
Figure 16:
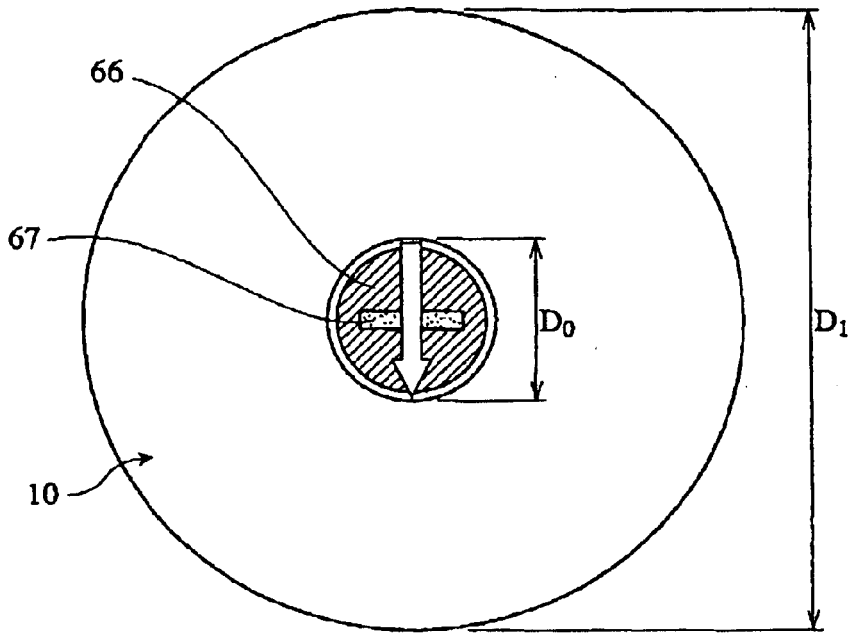
FIG. 16 is a cross-sectional view taken along the line A—A in FIG. 15.
Figure 17:
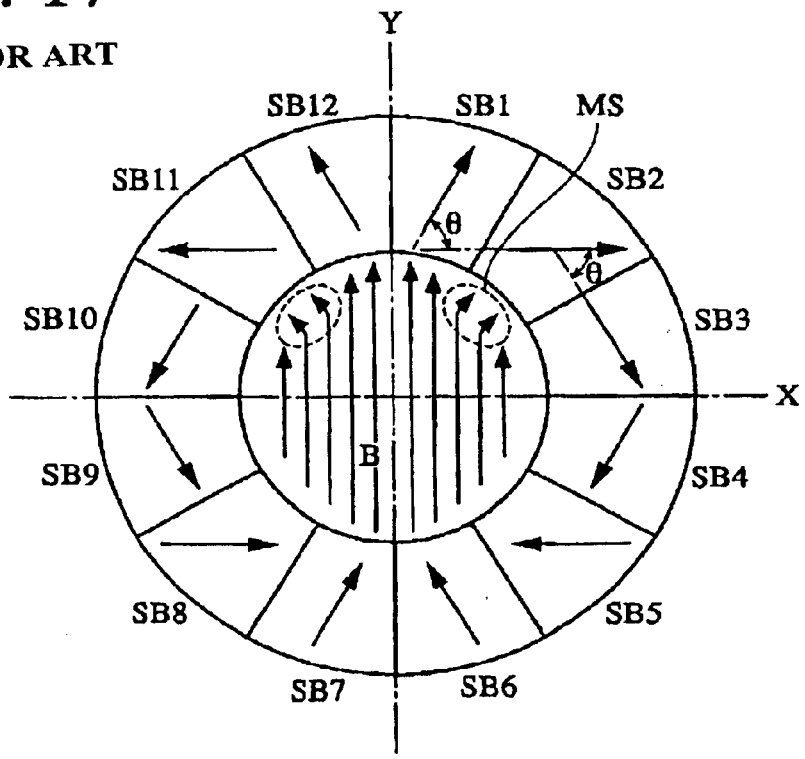
Fig. 17 PRIOR ART
FIG. 17 is a plan view showing an example of a conventional Halbach-type magnetic circuit.

FIG. 15 shows the detailed cross section of the extrusion-molding apparatus in an orientation part, and FIG. 16 shows a cross section taken along the line A—A in FIG. 15. In the figures, white arrows represent the direction of a magnetic field. The green body 67 is formed into a desired shape by a die 66*a* in the forming die assembly 66, cooled by a cooling means 66*b*. An orientation region in the magnetic-field-generating apparatus should extend close to an outlet of the cooling means 66*b*. Though orientation is conducted in the die 66*a* at a high temperature, friction between the green body 67 and the die assembly 66, through which a cooling means flows, disturbs the orientation of the green body 67 on the surface therefore, to correct orientation disturbance on the green body surface, it is important to uniformly orient the green body 67 up to the outlet of the cooling means 66*b*, at which the green body 67 is so cooled that there is no orientation disturbance. The center 10*a* of the magnetic-field-generating apparatus 10 was aligned to the center position of the die 66*a*, and the distance t from the outlet end of the cooling means 66*b* of the forming die assembly 66 to the effective magnetic field region 10*b* of the magnetic-field-generating apparatus 10 was 15 mm. Because the green body 67 slides along a cavity surface during extrusion, it has a disturbed orientation on the surface, and the surface orientation disturbance cannot be corrected easily outside the effective magnetic field region 10*b*. Though it is ideal that the green body 67 is completely cooled in a magnetic field region 66*a*, molding can be conducted without decreasing the orientation of this green body 67 when the distance t is from 2 mm to 30 mm, in relation to a solidification speed. In addition, a green body 67, particularly as thin a green body as about 1 mm, is likely to be deformed immediately after extruded from the forming die assembly 66, by magnetic flux leaking from the magnetic-field-generating apparatus 10. Accordingly, a magnetic shielding means 10*c* is effectively arranged around the magnetic-field-generating apparatus 10.

Specifically, a flat, thin, anisotropic bond magnet oriented in a thickness direction was obtained as follows. First, an alloy comprising 32.5% by mass of Nd, 3.0% by mass of Dy, and 1.05% by mass of B, the balance being substantially Fe, was melted at a high frequency, strip-cast and coarsely pulverized. After hydrogen absorption and dehydrogenation, this coarse powder was further pulverized to 500 $\mu$m or less. This powder was mixed with 0.05 to 0.10% by mass of paraffin wax, and finely pulverized by a jet mill containing a nitrogen gas as a pulverization medium at pressure of 0.69 MPa (7 kgf/cm$^2$). The resultant alloy powder had an average particle size of 4.2 $\mu$m.

93% by mass of the alloy powder was blended with 2.0% by mass of an ethylene-vinyl acetate copolymer (EVA), 1.5% by mass of polyethylene (PE), and 3.5% by mass of paraffin wax (PW) as thermoplastic binders. The resultant material 70 was introduced into the barrel 63 via the hopper 62, conveyed to the forming die assembly 66 in a molten state at a temperature of 150 to 230° C. while being sheared by the rotation of a pair of screws 64, and passed through a molding space in the forming die assembly 66 while its cross section was reduced to a predetermined area in a magnetic field. The green body 67 was extruded from the die, provided with anisotropy near the die outlet and then discharged from the magnetic-field-generating apparatus 10. Molding was conducted at an extrusion speed of 1–2 cm/s, with a non-orientation region of 15 mm. An extrusion-molded preliminary green body was a thin plate having a thickness of 1.0 mm and a width of 10.0 mm. This preliminary green body was punched out to a thin green body of 7 mm each. This thin green body was sandwiched by a BN plate having a surface roughness Ra of 10 $\mu$m and a thickness of 2.0 mm, and placed in the furnace. The pressure of the BN plate on the green body was 51.0 Pa (0.52 gf/cm$^2$), due to the weight of the BN plate. 50 g of Nd—Fe—B magnet powder as an oxygen absorber was arranged near the green body. Thereafter, this green body was heated to 615° C. at a temperature-elevating speed of 20° C./h in hydrogen for degreasing. The green body was heated to 1100° C. at a temperature-elevating speed of 200° C./h in Ar for sintering.

The present invention provides a magnetic-field-generating apparatus having a wide region stable in the strength, uniformity and parallelness of a magnetic field, particularly having excellent magnetic field parallelness and suppressed magnetization bending in the hole. The magnetic-field-generating apparatus of the present invention can generate a uniform, parallel magnetic field as strong as 1.0 T or more.

The heat-treating-in-magnetic-field furnace using the magnetic-field-generating apparatus of the present invention can apply a uniform, parallel magnetic field to pluralities of articles such as magnetic film substrates with suppressed magnetization bending, thereby conducting high-quality heat treatment at a low cost.

The extruder using the magnetic-field-generating apparatus of the present invention can also apply a uniform, parallel magnetic field to an article such as a magnet powder/resin blend with suppressed magnetization bending, thereby producing high-quality permanent magnets with high magnetization orientation.

What is claimed is:

1. An magnetic-field-generating apparatus comprising permanent magnet segments in the number of N, wherein N is an even number of 4 or more, arranged to form a ring-shaped magnetic circuit having a center hole; adjacent permanent magnet segments having such different magnetization directions that their magnetization directions successively change along a circumferential direction of said magnetic circuit; a basic magnetization phase angle θ between the magnetization directions of said adjacent permanent magnet segments being 720/N (°); and a magnetization direction of at least one permanent magnet segment in an essential unit obtained by circumferentially dividing said ring to ¼ being deviated from said basic magnetization phase angle θ by such a deviating angle that a uniform magnetic flux flows in one direction along a diameter of said center hole.

2. The magnetic-field-generating apparatus according to claim 1, wherein said permanent magnet segments are arranged with a predetermined gap between adjacent permanent magnet segments.

3. The magnetic-field-generating apparatus according to claim 1, wherein said ring is constituted by four essential units comprising four symmetric quarters in the first to fourth quadrants, with magnetization directions successively changing clockwise in the first and third quadrants, and counterclockwise in the second and fourth quadrants.

4. The magnetic-field-generating apparatus according to claim 1, wherein the magnetization direction of a permanent magnet segment arranged at about 45° is deviated from said basic magnetization phase angle θ in each essential unit.

5. The magnetic-field-generating apparatus according to claim 1, wherein said deviating angle is +15° or less.

6. The magnetic-field-generating apparatus according to claim 1, wherein the number N of said permanent magnet segments is an even number of 8 to 20.

7. The magnetic-field-generating apparatus according to claim 6, wherein the number N of said permanent magnet segments is 12.

8. The magnetic-field-generating apparatus according to claim 1, wherein a magnetic field parallelness at least at about 45° is within ±1° within 50 to 70% from the center of said hole in a substantially entire axial region of said magnetic circuit.

9. A magnetic field orientation apparatus comprising the magnetic-field-generating apparatus recited in claim 1, and a heat treatment apparatus disposed in the hole of said magnetic-field-generating apparatus, said heat treatment apparatus comprising a cooling means, a heating means, and a means for holding articles to be heat-treated in this order from outside.

10. A magnetic field orientation apparatus comprising the magnetic-field-generating apparatus recited in claim 1 around a magnetic orientation die for producing permanent magnets.

* * * * *